United States Patent [19]

Linda et al.

[11] Patent Number: 4,869,726

[45] Date of Patent: Sep. 26, 1989

[54] METHOD AND AN APPARATUS FOR MARKING FABRIC PILES

[75] Inventors: Karl G. Linda; Jan L. Nielsen, both of Aulum, Denmark

[73] Assignee: JPS Marking ApS, Aulum, Denmark

[21] Appl. No.: 159,897

[22] Filed: Feb. 24, 1988

[30] Foreign Application Priority Data

Feb. 26, 1987 [DK] Denmark ..... 983/87

[51] Int. Cl.[4] ..... D06P 5/00; B05B 7/14

[52] U.S. Cl. ..... 8/498; 8/499; 118/308; 118/300; 427/285; 427/286; 68/205 R

[58] Field of Search ..... 8/498, 499, 148; 68/205 R; 427/285, 286; 118/308, 300; 33/9 A

[56] References Cited

U.S. PATENT DOCUMENTS 3,292,529 12/1966 Musican ..... 101/26

4,020,789 5/1977 Gaurvrellis ..... 118/308

4,021,876 5/1977 Engelhardt ..... 118/252 X

*Primary Examiner*—Evan Lawrence

*Attorney, Agent, or Firm*—Antonelli, Terry & Wands

[57] ABSTRACT

For providing a vertical line marking on the side of a pile of cut out fabric members in order to provide a mark on the edge of all these members it is customary to brand a line mark into the side of the pile by means of a vertical branding wire or edge. For avoiding a number of associated drawbacks, a marking member is used which includes an axially slotted tube placed with a slot thereof engaging the pile side. The tube is connected with an injector for injecting into the tube a pulse of pressurized air holding a dyestuff powder, which is thus exhausted through the slot and into the pile side so as to intrude into the edge region of all the single fabric members and thereby provide a visible marking. The upper end of the tube receives a stopper piston having at its lower end a foot member projecting outwardly through the slot so as to be engageable with the top side of the pile and thus limit the operative length of the slot to the actual height of the pile.

6 Claims, 1 Drawing Sheet

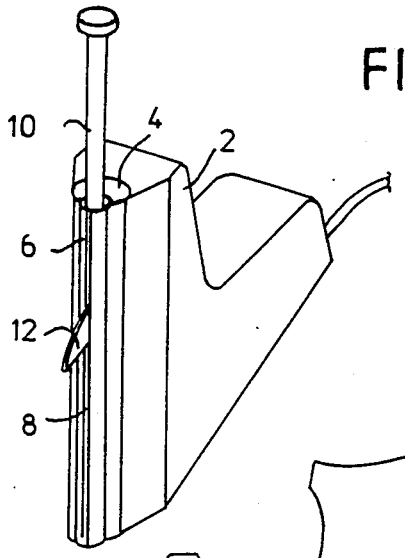
FIG. 1
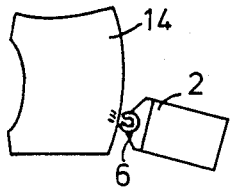
FIG. 2
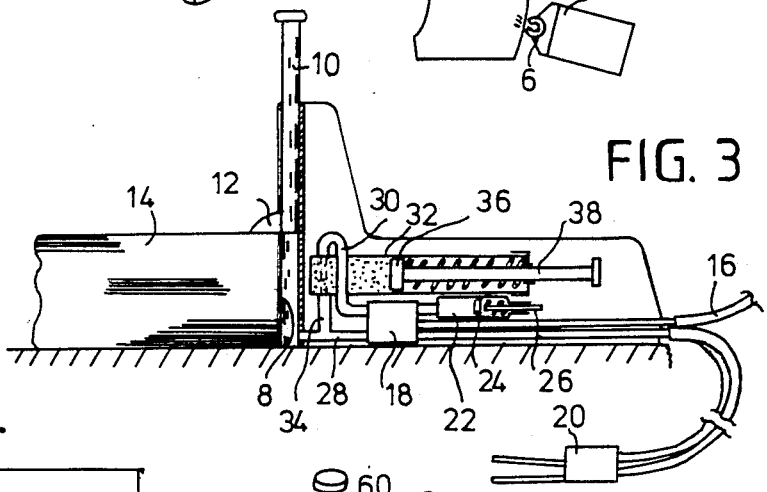
FIG. 3
FIG. 4
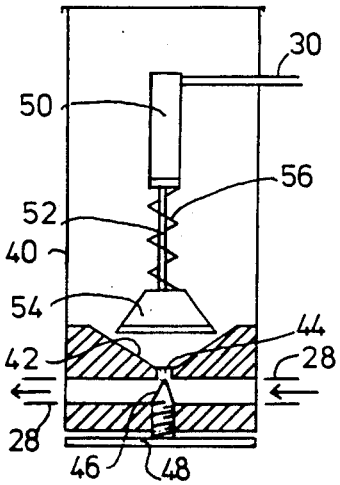
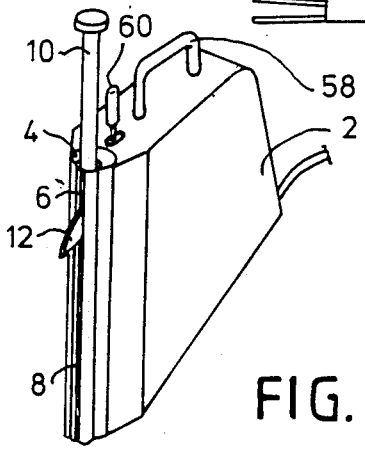
FIG. 5

METHOD AND AN APPARATUS FOR MARKING FABRIC PILES

BACKGROUND OF THE INVENTION

The present invention relates to a method and an apparatus for line marking of the edge surfaces of cut out piles of fabric members. In the clothing industry it is common practice that similar fabric members for a series of articles are cut out together from a pile of fabric layers by, for example, a bandsaw, and it is frequently desirable to produce a discrete marking of certain edge points of the single members, e.g. for showing the later position of a ziplock. Such marking should comprise all the members in the pile, so in practice it is effected by marking the edge surface of the pile with a vertical line leaving a mark on the single members.

A simple manner of line marking the pile is to draw a line with a piece of chalk of a light/dark-contrasting shade, but the achieved marking of the single members is not too clear, and it is difficult to draw the line right to or from the lowermost members resting on a table top. A generally preferred method is to brand the pile side by means of a vertical branding wire or edge mounted in a stationary or movable holder having a land for limiting the intrusion depth of the branding tool. The result is a small notch in the single fabric members, normally further visualized by the notch edge being burnt brown.

Even that method, however, involves drawbacks, though these have been generally accepted as unavoidable. The branding generates unpleasant smoke, and fabric members rich in artificial fibres tend to melt together at the mrking area. Also here it is difficult to mark the lower-most layers on a table top.

SUMMARY OF THE INVENTION

It is the purpose of the invention to provide an immproved marking method, that will condition an easy, effective and rapid marking in an advantageous manner.

According to the invention a line marking member in the form of an axially slotted tube is brought to engage the pile side with the slot facing the side, whereafter an air flow and a color substance are injected into the tube in such a way that the color substance is driven out of the slot all over the effective length thereof and is blown a short way into the surface of the pile side. By this intrusion of the color, which may be powder or atomized liquid, a sufficiently clearly visible marking of each fabric member will be achievable, the color of course being chosen as a contrasting colour. The intrusion is well controllable so as to be just suitable and not undesirable excessive. The exhaust through the slot may take place very uniformly along the slot even when the air and color are injected into the tube from a single end or area thereof.

The dyestuff may be fully harmless, and normally no special ventilation or suction will be required. The air may be supplied as pulses of pressurized air in an inexpensive and easy manner, and no adhesion between the fabric members will be created. Moreover, the pile may be marked all the way down to the lowermost layer, since the slot may extend to the lower end of the tube as rested against the table top.

The associated apparatus according to the invention may be designed so as to enable an easy adjustment of the effective length of the slot according to the individual heights of the piles, by, for example, having in the upper end of the pipe a stopper piston insert, which is height adjustable to the level of each pile top. The piston may have a foot portion projecting outwardly through the slot so as to be lowerable against the top of each pile and thus automatically determine the correct height position of the stopper piston. Hereby any free outslip of dyestuff is avoided in a simple manner.

In the following the invention is described in more details with reference to the accompanying drawing.

BRIEF DESCRIPTION OF THE DRAWINGS

FIG. 1 is a perspective view of an apparatus according to the invention;

FIG. 2 is a top view thereof, shown in an operative position against a side area of a pile of fabric members;

FIG. 3 is a schematic lateral view of the apparatus; and

FIGS. 4 and 5 are views of two modifications of the apparatus of the present invention.

DETAILED DESCRIPTION

The apparatus shown comprises a housing 2 having at a vertical front end an upstanding cylindrical holding body 4 for an outermost vertical tube 6, which is received in a holding recess in the body 4. The tube 6 is shaped with a foremost, throughgoing vertical slot 8 of a width of, for example, ½–3 mm. From above a displaceable rod 10 is introduced into the tube 6, fitting in the tube with sufficient friction to be self holding therein and closing the tube upwardly, the rod 10 at its lower end having a foot member 12 projecting outwardly through the slot 8.

As indicated in FIG. 2, the apparatus will be mountable against a side area of a cut out pile 14 of fabric members preferably by such a pile being moved on a table top into engagement with a stationary apparatus. Thereafter the raised rod 10 is displaced downwardly until the foot member 12 engages the top side of the pile, whereby only that portion of the slot 8, which extends from the table top upwardly along the pile will be left open, forwardly, towards the pile.

Inside the housing 2, as explained in more detail below, means are provided for pulswise supplying of pressurized air with a content of a dyestuff to the lower end of tube 6, so that the dyestuff will be blown into the engaged side area of the pile 14 through the vertical slot 8. The dyestuff will be pressed into this area as a thin streak, and by adjusting the air pressure care is taken that the intrusion depth of the dyestuff will be of a desired small value, yet sufficient to produce a visible marking on the edge of each single fabric member in the pile 14.

Due to the tightening rod 10, the exhaust of dyestuff will be effected through the slot 8 only over the sublength thereof located adjacent to the pile 14, irrespective of the height thereof, and thus no free outslip of dyestuff will occur.

The dyestuff may be supplied in different manners, but a practical example is shown in FIG. 3. Through a hose 16 compressed air is led to a switch 18, from which the air is distributed to a pedal switch 20 and to a pressure vessel 22 of the type which is provided with a spring loaded piston 24, which is forced rearwardly against the end of a stop rod 26, with this stop rod 26 being axially adjustable from outside. From the unit 18 a hose is connected direct to a side inlet on the lower end of the tube 6, and hose 30 is connected to a side inlet on the front end portion of a cylinder 32. Oppositfe to this inlet the cylinder 32 has an outlet connector for a hose 34 leading to the lower inlet of the tube 6. The cylinder 32 contains a dyestuff powder, which is pressed forwardly by a spring loaded piston 36 on a rearwardly protruding rod 38, by which the piston may be retracted when dyestuff is to be refilled.

Foremost in the cylinder 32 an end portion thereof is shaped with a narrow vertical slit between the opposed ends of the hoses 30 and 34, so that from this split dyestuff powder will be brought along in a restricted flow whenever the hose 30 is subjected to pressurized air.

The switch unit 18 is designed so as to break, when actuated, the connection between the supply hose 16 and the cylinder 22 and connect the latter to the hoses 28 and 30 so that these will receive an air pulse corresponding to the volume driven out from the cylinder 22 by the piston 24. The major part of this air is guided through the hose 28 down to the lower inlet to the tube 8, while a partial flow will concurrently serve to convey dyestuff powder through the hose 34 into the main air flow through the hose 28.

Even by a very brief pulse of compressed air, the air with its added contents of dyestuff powder will flow into the tube 6 and be exhausted through the slot 8 along the whole length thereof, so that all the fabric members in the pile 14 will be edge marked by the intruding dye powder.

For an optimal performance the volume of the air pulse should be adapted at least roughly to the height of the pile, as a low pile will, of course, require less air than a high pile for obtaining a similar marking of the single layers. Such an adaptation can be effected by manually adjusting the position of the stop rod 26, but it is easily possible to achieve a corresponding automatic adjustment based on the height positioning of the rod 10, by coupling together the rods 10 and 26 or in any other manner.

Instead of a dyestuff powder use may be made of an atomized liquid dyestuff, which could even be let in through the lower end of the rod 10.

The dyestuff cylinder may be recharged with the use of a powder cartridge for facilitating the refilling.

In FIG. 4 is shown a modified dyestuff container 40 for use instead of the cylinder 32. It comprises a conical bottom portion 42 having a central hole 44, which leads to the passage 28 and is partly closed by a pin screw 46 having an exterior screw head 48. Inside the container is mounted an air cylinder 50 having a downwardly projecting piston rod 52 with a lower head block 54 cooperating with the bottom portion 42. A drawspring 56 is arranged for biasing the rod 52 and the head block 54 upwardly, and the top of the cylinder 50 is connected with the hose 30 in such a way that the head block 54 is urged downwardly by every marking operation. The top of the container may be open or covered by a simple lid, for easy refilling. By each operation the head block 54 will press dyepowder through the hole 44 and the dosage is adjustable by turning the screw head 48.

FIG. 5 shows a modified apparatus having a carrier handle 58 and a manually operated trigger 60, which replaces the pedal switch 20.

The required air pulses are quite brief and thus without any large volume. For that reason the apparatus could have its own air source such as an electromagnetically driven piston pump delivering, by each working stroke, the required volume of air.

For making piles of small height it may even be sufficient to make use of a hand or foot operated ball or bellow, though generally a satisfactory intrusion depth of the dyestuff into the side of the pile will require an increased pressure relative the known powder blowers for surface marking.

What is claimed is:

1. A method of line marking an edge surface of a pile of fabric members with a vertical line marking member engageable with a side area of the pile of fabric members to mark the same, the method comprising the steps of bringing the line marking member in the form of an axially slotted tube into said enggement with the side area of the pile of fabric members with the slot thereof facing a side of the pile, and injecting an air flow and an air suspensible dyestuff into the tube so that the dyestuff is exhausted through the slot and blown a short distance into the surface of the side of the pile of fabric members.

2. An apparatus for line marking an edge surface of a pile of fabric members, the apparatus comprising a vertical line marking means including an axially slotted tube engageable with a side area of said pile with the slot thereof facing the side area means connected with the axially slotted tube for injecting a pulse of pressurized air and a flow or amount of a dyestuff as a powder or an atomized liquid into the tube and for exhausting the dyestuff through the said slot all over an operative length thereof so that the dyestuff is blown a short distance into the surface of the side of the pile of fabric members.

3. An apparatus according to claim 2, wherein the slot extends all the way down to a lower end of the axially slotted tube, said lower end being positionable against a table top.

4. An apparatus according to claim 2, wherein an upper end of the axially slotted tube is closed by an axially displaceable stopper rod having at a lower end thereof a foot member projecting outwardly through said slot so as to be engageable with a top side of said pile of fabric members to be marked.

5. An apparatus according to claim 2, wherein means are provided for adjusting the injecting means with respect to the volume of said pulse.

6. An apparatus according to claim 2, wherein said means for injecting dyestuff into the axially slotted tube includes means for injecting the dyestuff in a controlled manner into an air flow supplied to the axially slotted tube.

* * * * *